US005724874A

United States Patent [19]

Lindee et al.

[11] Patent Number: 5,724,874

[45] Date of Patent: Mar. 10, 1998

[54] METHOD OF MANUFACTURING FOOD LOAF SLICE GROUPS

[75] Inventors: Scott A. Lindee; Wilbur A. Janssen, both of New Lenox; Thomas C. Wolcott, Oak Lawn, all of Ill.

[73] Assignee: Formax, Inc., Mokena, Ill.

[21] Appl. No.: 690,327

[22] Filed: Jul. 25, 1996

Related U.S. Application Data

[63] Continuation of Ser. No. 320,750, Oct. 11, 1994, abandoned.

[51] Int. Cl.[6] ..... B26D 7/30

[52] U.S. Cl. ..... 83/27; 83/77; 83/86; 83/102; 83/403.1; 83/932

[58] Field of Search ..... 83/23, 27, 77, 83/88, 102, 155.1, 356, 932, 272, 403.1

[56] References Cited

U.S. PATENT DOCUMENTS

| | | | |
|---|---|---|---|
| 2,834,388 | 5/1958 | Meyer . | |
| 3,605,837 | 9/1971 | Lambert et al. . | |
| 3,821,913 | 7/1974 | Bajcar et al. | 83/77 |
| 3,827,319 | 8/1974 | Flesch . | |
| 3,906,823 | 9/1975 | Spooner . | |
| 3,995,517 | 12/1976 | Smith . | |
| 4,226,147 | 10/1980 | Kumzi . | |
| 4,321,847 | 3/1982 | Dillon . | |
| 4,405,186 | 9/1983 | Sandberg et al. . | |
| 4,428,263 | 1/1984 | Lindee et al. . | |
| 4,532,840 | 8/1985 | Antonissen . | |
| 4,548,107 | 10/1985 | Marchese et al. . | |
| 4,572,044 | 2/1986 | Antonissen . | |
| 4,580,475 | 4/1986 | Antonissen . | |

*Primary Examiner*—Kenneth E. Peterson
*Attorney, Agent, or Firm*—Dorn, McEachran, Jambor & Keating

[57] ABSTRACT

A high speed food loaf slicing machine slices two food loaves simultaneously, using one cyclically driven knife blade; the slices are stacked or shingled in groups on a receiving conveyor located below the slicing station. Independent loaf feed drives are provided; slices cut from one loaf may be thicker than slices from the other. Each loaf feed drive includes two "short" conveyors each driven at a predetermined speed; the conveyor speeds may be different. In each machine cycle the receiving conveyor is moved down to accommodate an increasing number of slices; when a slicing cycle is completed, the receiving conveyor rapidly discharges the slice groups onto a deceleration conveyor and moves back up to start a new slicing operation. The loaf feed drives are reversed at the end of a slicing cycle, stopped, and then reversed again before the next slicing cycle. In each machine cycle previously cut groups of slices are weighed as they traverse a scale conveyor; the weights thus determined control two transfer conveyors, one for each loaf sliced. The weights also control the loaf feed drives that determine slice thickness.

5 Claims, 9 Drawing Sheets

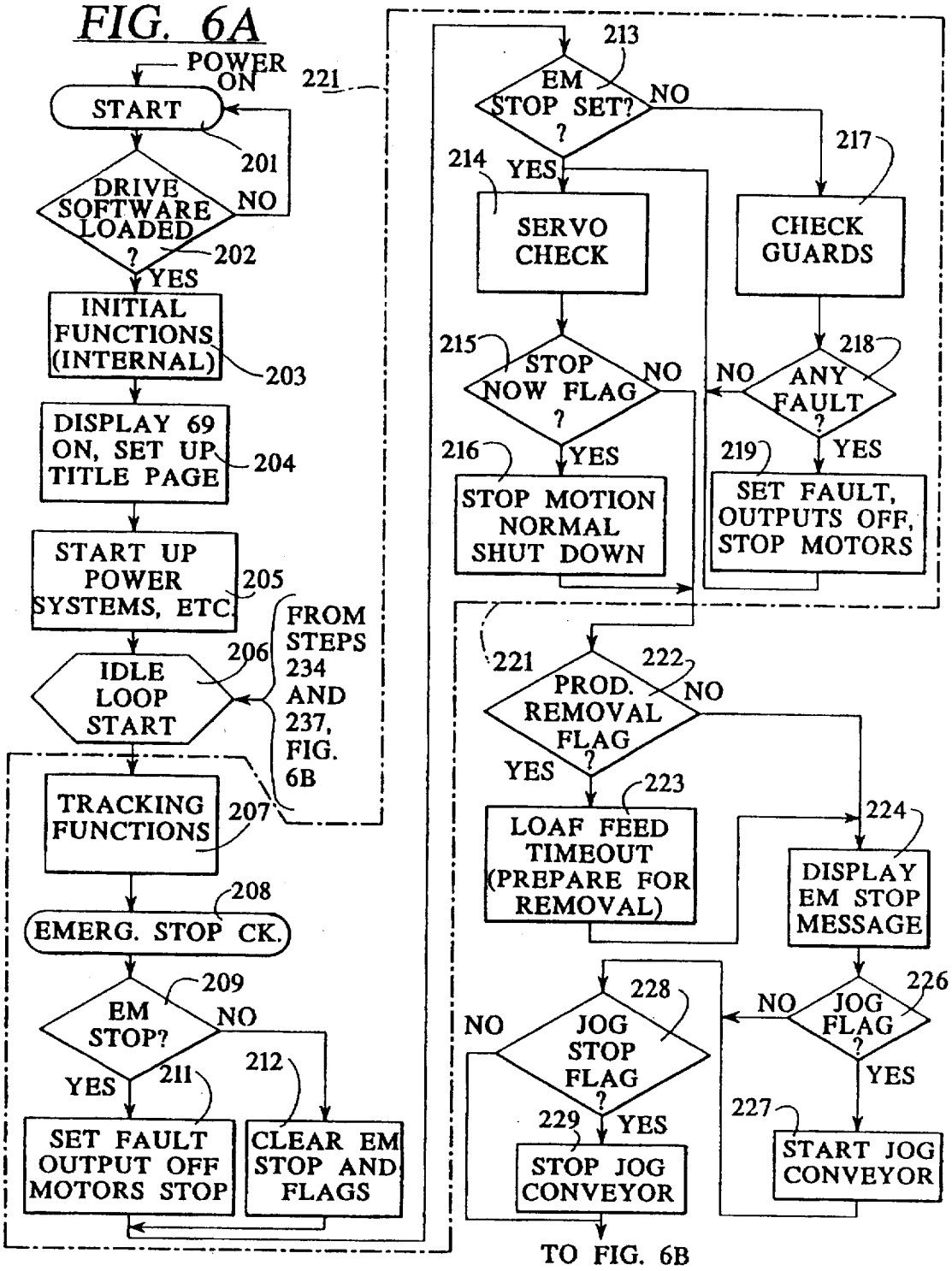
FIG. 6A
POWER ON
START
201
DRIVE SOFTWARE LOADED ?
NO
202
YES
INITIAL FUNCTIONS (INTERNAL)
203
DISPLAY 69 ON, SET UP TITLE PAGE
204
START UP POWER SYSTEMS, ETC.
205
IDLE LOOP START
206
FROM STEPS 234 AND 237, FIG. 6B
TRACKING FUNCTIONS
207
EMERG. STOP CK.
208
EM STOP?
209
NO
YES
211
212
SET FAULT OUTPUT OFF MOTORS STOP
CLEAR EM STOP AND FLAGS
221
EM STOP SET?
213
NO
YES
214
SERVO CHECK
217
CHECK GUARDS
STOP NOW FLAG ?
215
NO
YES
216
STOP MOTION NORMAL SHUT DOWN
ANY FAULT ?
218
NO
YES
219
SET FAULT, OUTPUTS OFF, STOP MOTORS
221
PROD. REMOVAL FLAG ?
222
NO
YES
223
LOAF FEED TIMEOUT (PREPARE FOR REMOVAL)
224
DISPLAY EM STOP MESSAGE
JOG FLAG ?
226
NO
YES
227
START JOG CONVEYOR
JOG STOP FLAG ?
228
NO
YES
229
STOP JOG CONVEYOR
TO FIG. 6B

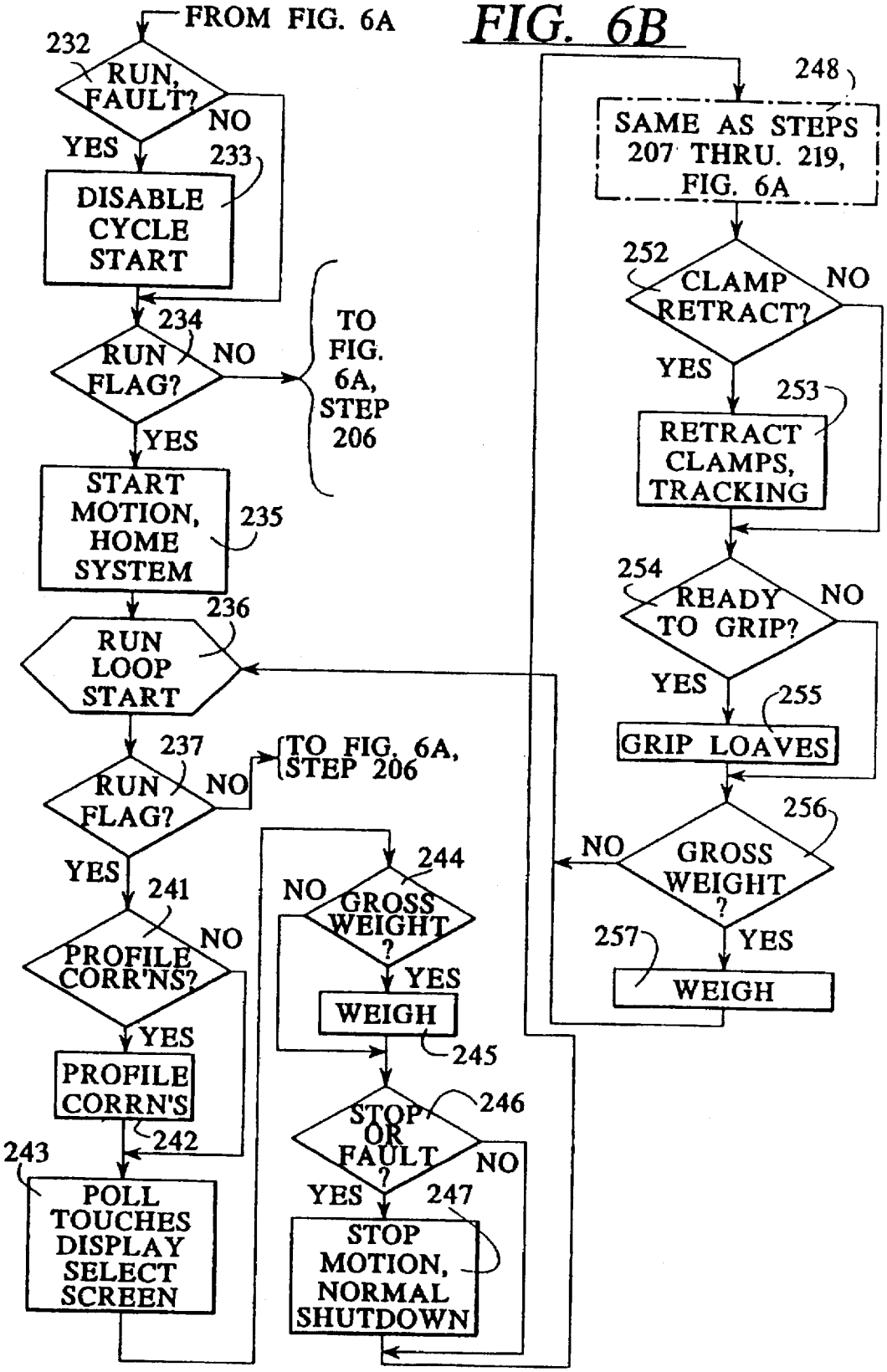
FIG. 6B
FROM FIG. 6A
232
RUN, FAULT?
NO
YES
233
DISABLE CYCLE START
234
RUN FLAG?
NO
TO FIG. 6A, STEP 206
YES
START MOTION, HOME SYSTEM
235
236
RUN LOOP START
237
RUN FLAG?
NO
TO FIG. 6A, STEP 206
YES
241
PROFILE CORR'NS?
NO
YES
PROFILE CORRN'S
242
243
POLL TOUCHES DISPLAY SELECT SCREEN
244
GROSS WEIGHT ?
NO
YES
WEIGH
245
246
STOP OR FAULT ?
NO
YES
247
STOP MOTION, NORMAL SHUTDOWN
248
SAME AS STEPS 207 THRU. 219, FIG. 6A
252
CLAMP RETRACT?
NO
YES
253
RETRACT CLAMPS, TRACKING
254
READY TO GRIP?
NO
YES
255
GRIP LOAVES
256
GROSS WEIGHT ?
NO
YES
257
WEIGH

METHOD OF MANUFACTURING FOOD LOAF SLICE GROUPS

This is a continuation of application Ser. No. 08/320,750 filed on Oct. 11, 1994, now abandoned.

BACKGROUND OF THE INVENTION

Many different kinds of food loaves are produced; they come in a wide variety of shapes and sizes. There are meat loaves made from various different meats, including ham, pork, beef, lamb, turkey, fish, and even meats not usually mentioned. The meat in the food loaf may be in large pieces or may be thoroughly comminuted. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Many of these food loaves meet a common fate; they are sliced, the slices are grouped in accordance with a particular weight requirement, and the groups of slices are packaged and sold at retail. The number of slices in a group may vary, depending on the size and consistency of the food loaf and even on the whim of the producer, the wholesaler, or the retailer. For some products, neatly aligned stacked slice groups are preferred. For others, the groups are shingled so that a purchaser can see a part of every slice through a transparent package. When it comes to bacon or other food products of variable shape, the problems do not just increase; they literally multiply.

A variety of different known slicing machines have been used to slice food loaves. They range from small, manually fed slicers used in butcher shops and in retail establishments to large, high speed slicers usually employed in meat processing plants. The present invention is directed to a high speed slicing machine of the kind used in a meat processing plant.

Some known high speed food loaf slicing machines have provided for slicing two food loaves simultaneously with a single, cyclically driven knife blade. Other prior high speed slicing machines, including that shown in S. Lindee et al. U.S. Pat. No. 4,428,263, have sliced one loaf at a time, but could be expanded to slice two or more loaves simultaneously. But none of the prior high speed slicing machines have had the versatility needed to slice two food loaves of the many different sizes and shapes referred to above, particularly with provision for either stacking or shingling of the sliced output, variations in slice thickness and slice count from two different loaves, and precision control of the weight of slice groups.

SUMMARY OF THE INVENTION

It is a principal object of the present invention to provide a new and improved method of manufacturing food loaf slice groups, using a versatile high speed slicing machine capable of slicing one, two, or more food loaves with a single cyclically driven knife.

Another object of the invention is to provide a new and improved method of manufacturing groups of food loaf slices, using a versatile high speed slicing machine, which method inherently protects against inadvertent slicing when not desired and can be used with food loaves of widely different sizes and shapes.

A further object of the invention is to provide a new and improved method of manufacturing gruops of food loaf slices, stacked or shingled, using a versatile high speed slicing machine, a method that incorporates self-correcting precision control so that the slicing machine is effectively adapted to a broad range of end use requirements.

These and other objects of the invention are realizable with the present invention as described more fully hereinafter.

Accordingly, the invention relates to a method of manufacturing a series of groups of food loaf slices, comprising the following steps:

A. driving a food loaf at a constant speed in a loaf feed direction toward engagement with a continuously cyclically driven knife blade for X knife blade cycles so that the knife blade cuts a slice from the food loaf in each knife blade cycle;

B. collecting successive food loaf slices cut in step A on a receiver to form a group of X food loaf slices on the receiver;

C. driving the food loaf away from the knife blade at a given speed for a given time interval Y;

D. again driving the food loaf toward the knife blade at the given speed for a second time interval Y to counteract step C;

E. during steps C and D, discharging the group of food loaf slices from the receiver;

F. after step E, weighing the group of food loaf slices to generate a weight signal representative of the weight of the food loaf slice group;

G. depositing the group of food loaf slices on a transfer conveyor;

H. deflecting the transfer conveyor between a reject position and an accept position in response to the weight signal of step F;

and repeating steps A through H in manufacturing a series of food loaf slice groups each including X slices.

BRIEF DESCRIPTION OF THE DRAWINGS

In the Drawings:

FIGS. 6A and 6B jointly comprise a flow chart for a computer control used in the slicing machine of FIGS. 1–5;

DESCRIPTION OF THE PREFERRED EMBODIMENTS

A. The Basic Slicing Machine, FIGS. 1–5.

Figure 1:
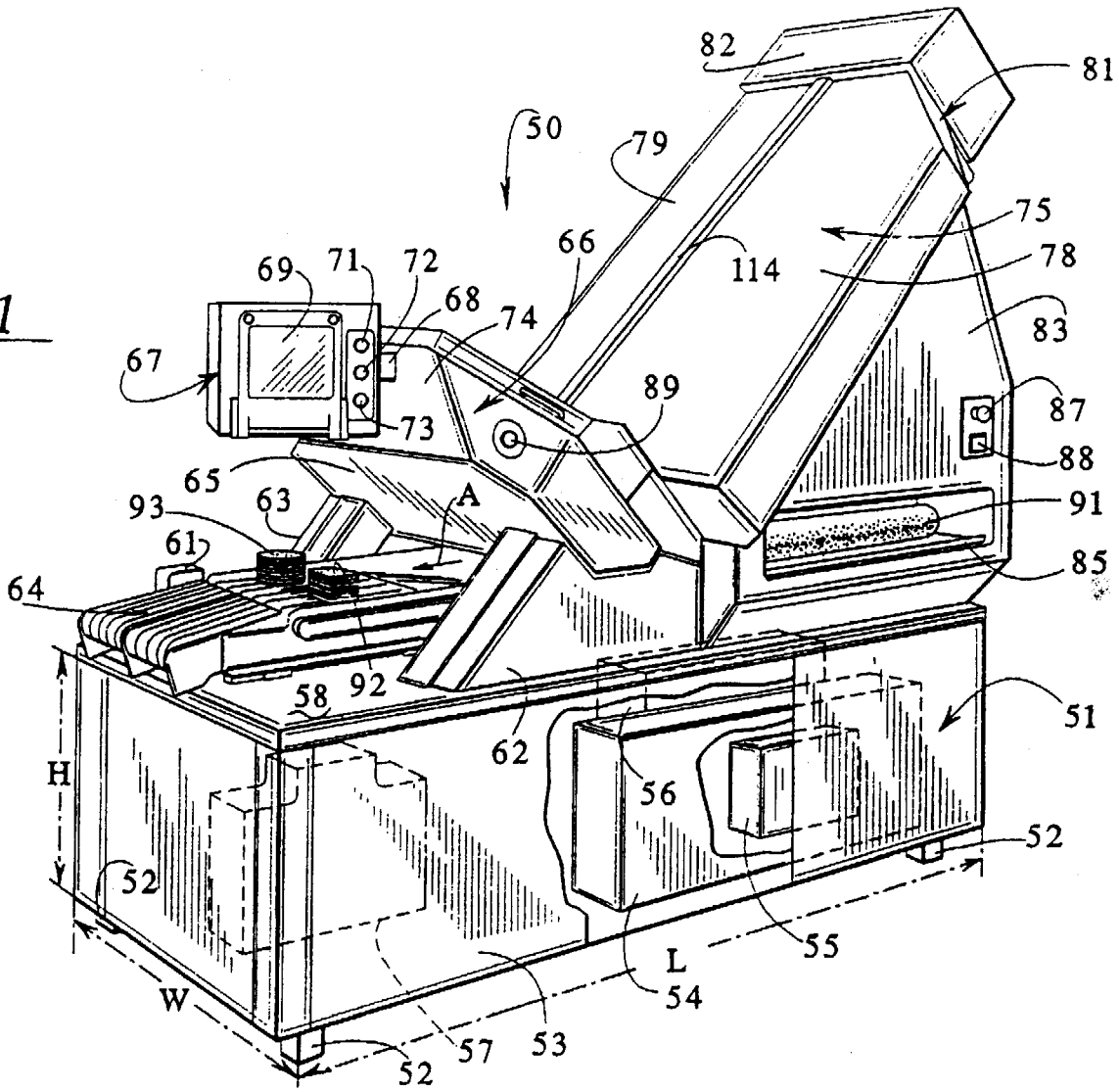
FIG. 1 is a perspective view of a versatile food loaf slicing machine utilizing a preferred embodiment of the operational sequence of the invention, with portions of the covers on the machine base cut away to show typical power supply and computer enclosures.

FIG. 1 illustrates a versatile food loaf slicing machine 50 that can be used to carry out a preferred embodiment of the present invention. Slicing machine 50 comprises a base 51 which, in a typical machine, may have an overall height H of approximately 32 inches (81 cm), an overall length L of about 103 inches (262 cm), and a width W of approximately 41 inches (104 cm). Base 51 is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale 57. Base enclosure 53 may also include a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45° and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing station 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71–73 and display/touch screen 69 are electrically connected to computer 54 in base 51.

The upper right-hand portion of the versatile slicing machine 50, as seen in FIG. 1, comprises a loaf feed mechanism 75 which, in machine 50, includes a manual feed on the far side of the machine and an automated feed on the near side of the machine. Loaf feed mechanism 75 has an enclosure that includes a far-side manual loaf loading door 79 and a near-side automatic loaf loading door 78. Slicing machine 50 is equipped for automated loading of loaves from the near side, as seen in FIG. 1, and manual loading of food loaves on the far side of the machine. Automated loaf loading may be provided on either or both sides of the machine; the same holds true for manual loaf loading.

Slicing machine 50, FIG. 1, further includes a pivotable upper back frame 81 and an upper back housing 82. Back frame 81 supports the upper ends of many of the components of loaf feed mechanism 75. A loaf feed guard 83 protects the near side of the loaf feed mechanism 75 and shields mechanism 75 from a machine operator. There may be a similar guard on the opposite side of the machine. There is a loaf lift tray 85 employed to load one or more food loaves into mechanism 75. A fixed loaf storage tray, used for manual loaf loading, is located on the opposite side of machine 50 but is not visible in FIG. 1.

An emergency stop switch 87 for interrupting all operations of slicing machine 50 is mounted on the near side of loaf feed guard 83. There may be a similar emergency stop switch on the opposite side of the machine. A loaf lift switch 88 for initiating automated loading of a loaf from tray 85 into mechanism 75 is located immediately below switch 87. An emergency stop switch 89 is mounted on slicing station 66 on the near side of machine 50, and there is a similar switch (not shown) on the opposite side of the slicing station. Switches 87, 88, and 89, and any counterparts on the opposite (far) side of slicing machine 50, are all electrically connected to the low voltage controls in enclosure 55.

As shown in FIG. 1, slicing machine 50 is ready for operation. There is a food loaf 91 on tray 85, waiting to be loaded into loaf feed mechanism 75 on the near-side of machine 50. Two or even three food loaves may be stored on tray 85, depending on the loaf size. Machine 50 produces a series of stacks 92 of food loaf slices that are fed outwardly of the machine, in the direction of the arrow A, by conveyor classifier system 64. Machine 50 produces a series of stacks 93 of food loaf slices that also move outwardly of the machine on its output conveyor system 64 in the direction of arrow A. Stack 92 is shown as comprising slices from a rectangular loaf, and stack 93 is made up of slices from a round loaf. Usually, both of the slice stacks 92 and 93 would be either round or rectangular. Stacks 92 and 93 may have different heights, or slice counts, and hence different weights; as shown they contain the same number of food loaf slices in each stack, but that condition can be changed. Both groups of slices can be overlapping, "shingled" groups of slices instead of having the illustrated stacked configuration. Groups 92 and 93 are the same in one respect; both are stacks or shingle groups. Three or more loaves can be sliced simultaneously; slicing of two loaves is more common.

Figure 2:
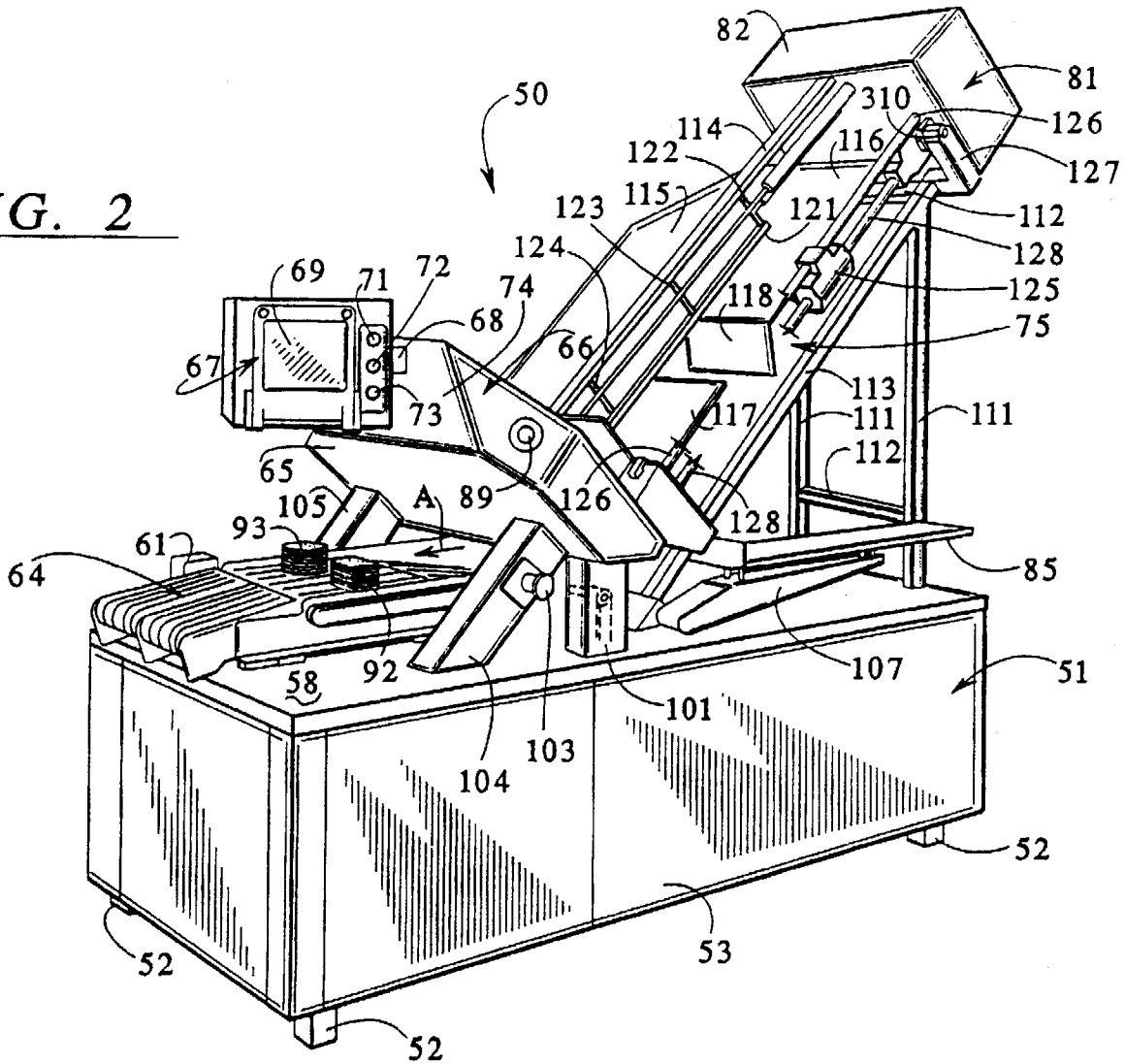
FIG. 2 is a perspective view, like FIG. 1, with some guards and covers for the loaf feed mechanism removed and some operating components of the loaf feed mechanism shown in simplified form.

FIG. 2 illustrates the versatile slicing machine 50 of FIG. 1 with a number of the covers omitted to reveal operating components of the automated loaf feed mechanism 75 on the near side of the machine. As shown in FIG. 2, there is a receiving conveyor drive 101 located on the near side of slicing machine 50. One part of the drive for slicing station 66 is enclosed within a support enclosure 104 on the near side of machine 50. A manual slicing station rotation knob 103 is mounted on and projects into enclosure 104 for mechanical connection to the slicing station drive. At the opposite side of slicing machine 50 there is an enclosure 105 for a knife drive. Slicing station drive enclosure 104 and knife drive enclosure 105 extend upwardly from table top 58 at an angle, preferably approximately 45°, corresponding to the angular alignment of mechanism 75. There is a manual knife rotation knob (not shown) on the far side of machine 50, corresponding to knob 103.

A loaf tray pivot mechanism 107 is located above top 58 of base 51 on the near side of slicing machine 50. Mechanism 107 is connected to and operates the automatic loaf lift tray 85.

Slicing machine 50 includes a fixed frame pivotally supporting the automated feed mechanism 75 for feeding food loaves into slicing head 66. In the construction shown in FIG. 2, this fixed frame includes a pair of vertical frame members 111 affixed to base 51 and interconnected by two horizontal frame members 112 and joined to two angle frame members 113 (only one shows in FIG. 2). Frame members 111–113 are all located above the top 58 of machine base 51. The loaf feed mechanism 75 in slicing machine 50 also includes a frame member 114 that extends from the upper back frame 81 downwardly, generally parallel to frame members 113, toward slicing head 66. The upper back frame 81 is mounted on pivot pins between the upper ends of two fixed frame members 127; only one member 127 appears in FIG. 2. All of the operating elements of the automated food loaf feed mechanism (see FIG. 5) are mounted on the back frame and are pivotally movable (through a small angle) relative to the fixed frame 111–113.

A manual feed tray 115 is shown at the far side of slicing machine 50 as illustrated in FIG. 2.

Mechanism 75 includes three loaf support components, two of which are preferably of unitary one-piece construction. At the top of slicing machine 50, as seen in FIG. 2, there is an upper loaf support tray 116 that has its upper surface aligned with the top surface of a lower loaf support tray 117. Supports 116 and 117 are preferably one piece, being joined by side members omitted in FIG. 2 to avoid overcrowding. The gap between loaf supports 116 and 117 is normally filled by a door 118; thus, members 116–118 normally afford a continuous loaf support surface that is the bottom for the two loaf paths in slicing machine 50. In FIG. 2, however, door 118 is shown in its open, loaf end discharge position. A textured upper surface is preferred for support members 116–118 to improve sliding movement of a food loaf along those support members toward slicing station 66.

The loaf feed mechanism 75 of slicing machine 50, FIG. 2, further includes a central barrier or divider 121, used to align two food loaves on supports 116–118. This central barrier/divider 121 is suspended from frame member 114 by a plurality of pivotal supports 122, 123 and 124. During operation of slicing machine 50 divider 121 is elevated from the position shown in FIG. 2 to permit loading of one or more food loaves onto the supports 116–118. Barrier 121 is also elevated during loaf slicing so that it will not interfere with other components of mechanism 75.

The part of food loaf feed mechanism 75 shown in FIG. 2 also includes a carriage 125 that is mounted upon a rotatable shaft 126 that extends parallel to the loaf support 116–118 throughout the length of food loaf feed mechanism 75. That is, carriage 125 moves along shaft 126 along a path approximately parallel to support members 113. There is a like carriage, carriage shaft, and carriage drive on the far side of slicing machine 50. See FIG. 5.

Figure 3:
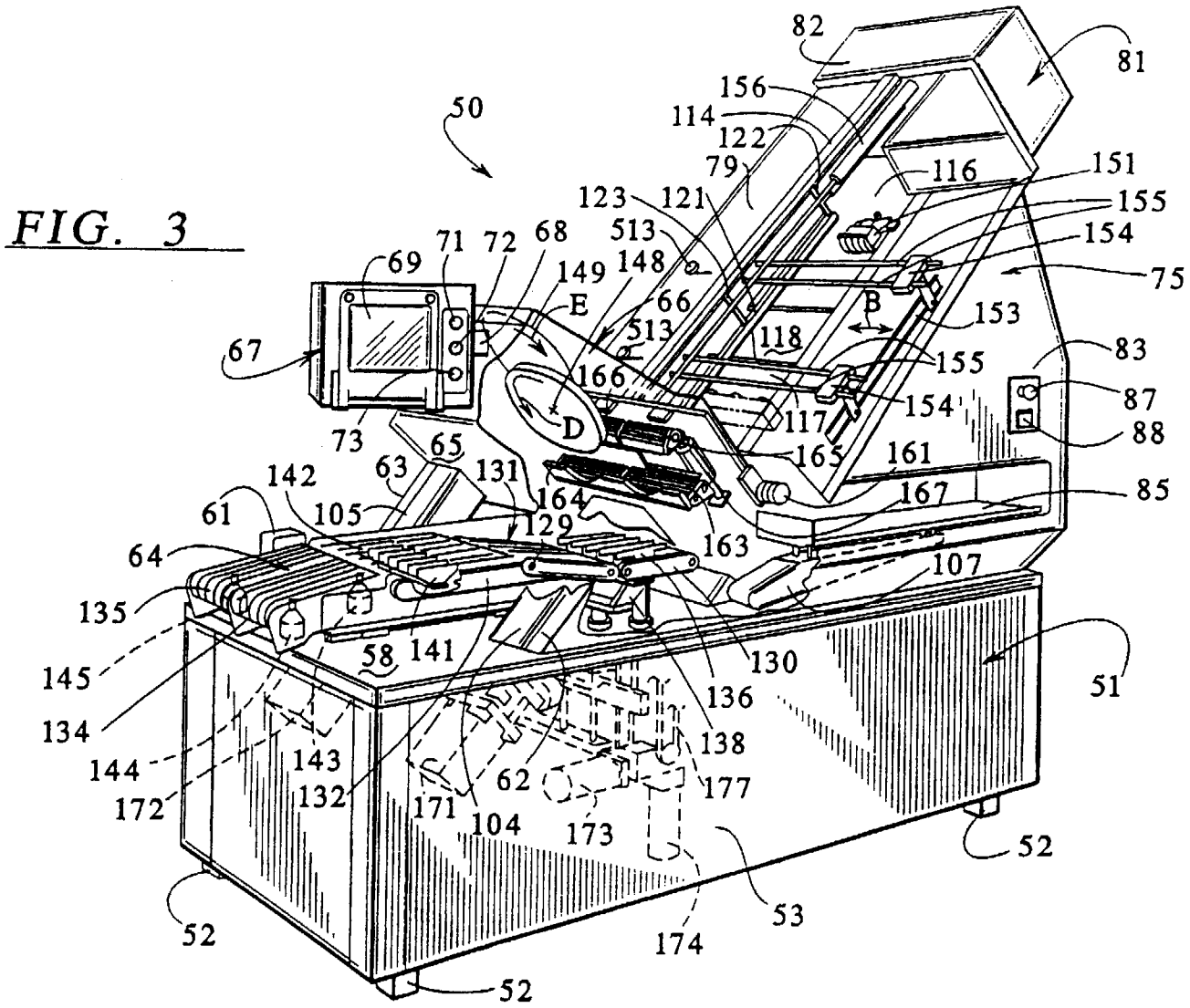
FIG. 3 is a perspective view, like FIGS. 1 and 2, with other guards and covers cut away to show further operating components of the slicing machine, some illustrated in simplified form.

FIG. 3 illustrates the same versatile slicing machine 50 that is shown in FIGS. 1 and 2 in a conceptual view showing additional components for loaf feed mechanism 75 and other parts of the slicing machine. Thus, FIG. 3 also illustrates the general arrangement of operating components within slicing head 66, one construction that may be used for conveyor/classifier system 64, and the drive motors for parts of slicing machine 50.

Referring first to conveyor/classifier system 64 at the left-hand (output) end of slicing machine 50, in FIG. 3, it is seen that system 64 includes an inner receiving conveyor 130 located immediately below slicing head 66; conveyor 130 is sometimes called a "jump" conveyor. From conveyor 130 groups of food loaf slices, stacked or shingled, are transferred to a deceleration conveyor 131 and then to a weighing or scale conveyor 132. From scale conveyor 132 the groups of food loaf slices on the near side of the machine move on to an outer classifier conveyor 134. On the far side of slicing machine 50 the sequence is the same, but that side of system 64 ends with a second outer classifier conveyor 135 located next to conveyor 134; see FIG. 4.

Slicing machine 50, FIG. 3, may further include a vertically movable stacking grid 136 comprising a plurality of stack members joined together and interleaved one-for-one with the moving elements of the inner stack/receive conveyor 130. Stacking grid 136 can be lowered and raised by a stack lift mechanism 138, as shown in FIG. 3. Alternatively, food loaf slices may be grouped in shingled or in stacked relationship directly on the receiver conveyor 130, with a series of stacking pins 137 replacing grid 136 (see FIG. 4). When this alternative is employed, lift mechanism 138 is preferably connected directly to and is used for vertical positioning of receiver conveyor 130.

Slicing machine 50 further comprises a scale or weighing grid including a first plurality of scale grid elements 141 and a second group of scale grid elements 142 interleaved one-for-one with the moving belts or like members of scale conveyor 132. Scale grids 141 and 142 are a part of scale mechanism 57 (see FIG. 1). A scale lift mechanism 143 is provided for and is mechanically connected to scale conveyor 132. There is no weighing mechanism associated with either of the two output or classifier conveyors 134 and 135. However, there is a classifier conveyor lift mechanism 144 connected to the near side classifier conveyor 134. A similar lift device 145 is provided for the other output classifier conveyor 135. Lift devices 144 and 145 are employed to pivot conveyors 134 and 135, respectively, from their illustrated positions to elevated "reject" positions, depending on the results of the weighing operations in machine 50 ahead of conveyors 134 and 135. See also FIG. 4.

In FIG. 3, slicing station 66 is shown to include a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion while it rotates. Other slicing head constructions may be used in machine 50, so long as the cutting edge of knife blade 149 moves cyclically along a predetermined cutting path to slice food loaves in station 66 in each cycle of operation.

As shown in FIG. 3, loaf feed mechanism 75 includes a near-side clamp or gripper mechanism 151. There is a similar gripper mechanism (not shown) at the far side of slicing machine 50. Gripper 151 is connected to and driven by carriage 125 (FIG. 2).

Loaf feed mechanism 75 further comprises a near-side sweep member 153 suspended from two sweep carriages 154 which in turn are each mounted upon a pair of sweep support rods 155. Sweep mechanism 153–155 is employed on the near side of machine 50. A corresponding sweep mechanism (not shown) may be located on the far side of a slicing machine equipped for automated loaf loading from both sides. A somewhat different but similar manual sweep may be used in machine 50. Sweep carriages 154 are driven along rods 155 by belts, not shown in FIG. 3, as indicated by arrows B. Rods 155 are connected to a rotatable sweep actuation shaft 156 for actuation thereby; see FIG. 5.

The versatile slicing machine 50 is intended to accommodate food loaves of widely varying sizes; it can even be used as a bacon slicer. This makes it necessary to afford a height adjustment for the food loaves as they move from loaf feed mechanism 75 into slicing head 66. In FIG. 3, this height adjustment is generally indicated at 161.

Slicing machine 50 further comprises two pair of short conveyors for advancing food loaves from loaf feed mechanism 75 into slicing head 66. The short conveyors are actually a part of loaf feed mechanism 75. FIG. 3 shows two short lower loaf feed conveyors 163 and 164 on the near and far sides of slicing machine 50, respectively. The short lower conveyors 163 and 164 are located immediately below two short upper feed conveyors 165 and 166, respectively. As used in describing conveyors 163–166, the term "short" refers to the length of the conveyors parallel to the food loaf paths along support 116–118, not to the conveyor lengths transverse to those paths. The upper conveyor 165 is vertically displaceable so that the spacing between conveyors 163 and 165 can be varied to accommodate food loaves of varying height. This adjustment is provided by an actuator 167. A similar actuator is located on the far side of machine 50 to adjust the height of the other upper short conveyor 166; the second lift actuator cannot be seen in FIG. 3.

Some of the drive motors for the operating mechanisms in slicing machine 50 are shown in FIG. 3. The drive motor for the head or spindle 148 in slicing station 66 is an A.C. variable speed servo motor 171 mounted in the machine base 51. A similar servo motor 172 drives the knife blade 149. The stacker lift 138 is driven by a stacker lift motor 173, again preferably a variable speed A.C. servo motor. On the near side of machine 50 the loaf feed drive mechanism comprising the carriage 125 for gripper 151 and the short loaf feed conveyors 163 and 165 is driven by a servo motor 174. A like motor 175 on the far side of machine 50 (not shown in FIG. 3) affords an independent drive for the gripper and the "short" loaf feed conveyors 164 and 166 on that side of the slicing machine; see FIG. 4.

Figure 4:
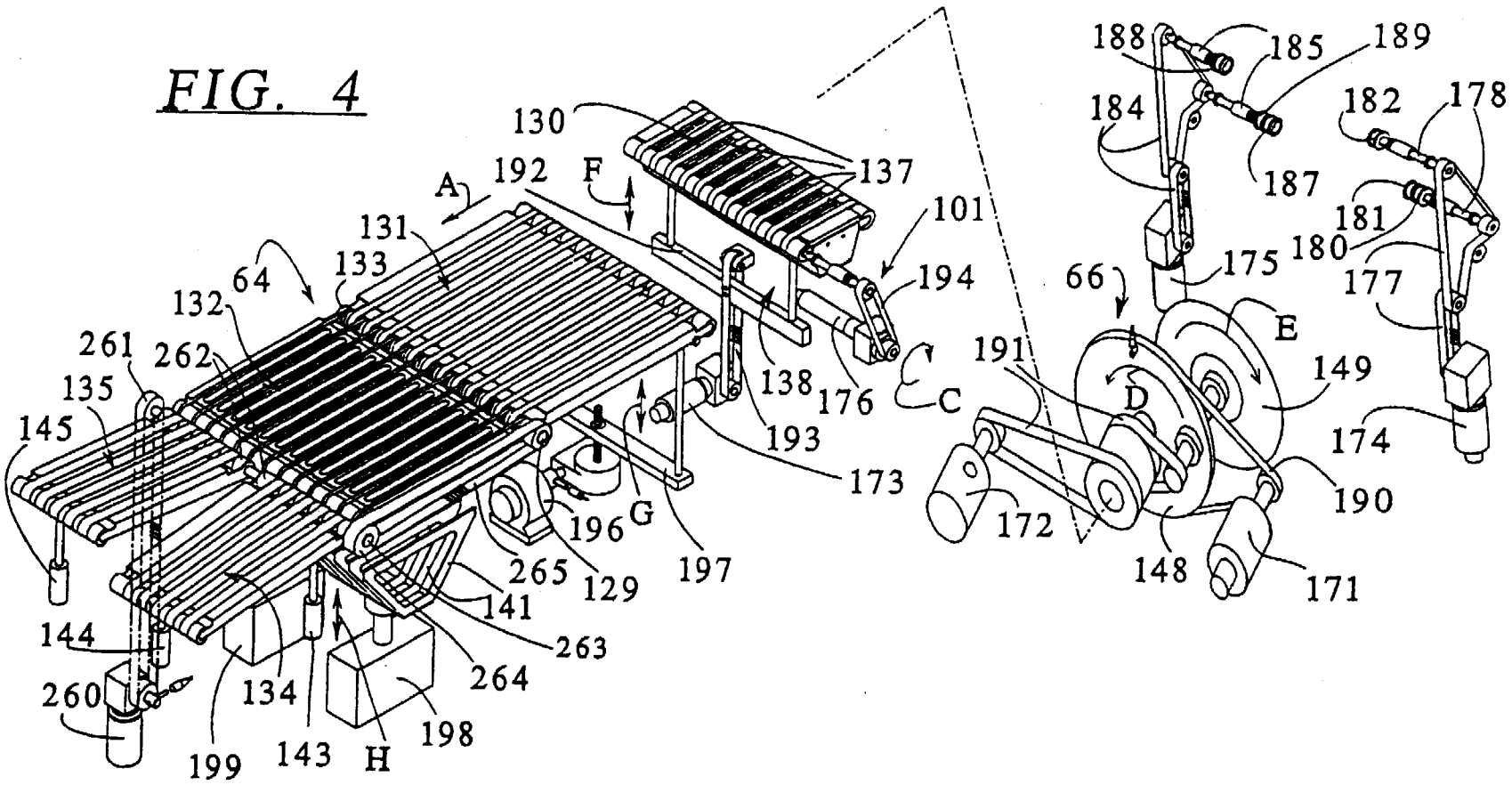
FIGS. 4 and 5 are schematic, simplified illustrations of operating components of the slicing machine of FIGS. 1–3.

FIG. 4 affords an extended, simplified illustration of the slicing, stacking or shingling, weighing, and discharge portion of the slicing machine 50 of FIGS. 1–3, along with the loaf feed drives. Thus, FIG. 4 provides a basis for description of many machine functions.

In FIG. 4, servo motor 174 is shown connected, as by a series of timing belts 177 and a pair of universal-joint drive connectors 178, in driving relation to loaf feed conveyor drive pulleys 181 and 182 and to another loaf feed belt drive pulley 180. Pulley 181 is the drive pulley for the near-side lower "short" loaf feed conveyor 163 (FIGS. 3 and 9); pulley 182 is the drive pulley for the near-side upper "short" loaf feed conveyor 165 (FIG. 3). Pulley 180 is the drive pulley for the belt 334 (FIG. 5) that drives gripper carriage 125. All of the loaf feed drive pulleys 180–182 (FIG. 4) have the same peripheral speed. Variation of the operating speed of servo motor 174 serves to vary the speed at which one food loaf is advanced into slicing station 66.

On the far side of FIG. 4 there is another servo motor 175 that, through a series of belts 184 and a pair of universal-joint drive connectors 185, drives the drive pulleys 187 and 188 for the far side "short" loaf feed conveyors 164 and 166; see FIG. 3. Motor 175 also drives a drive pulley 189 for a gripper carriage drive belt (not shown) that is a part of the food loaf feed on the far side of machine 50. The peripheral speeds for the loaf food drive pulleys 187–189 are all the same. The two servo motors 174 and 175 are adjustable in speed, independently of each other. Thus, either motor may have its speed regulated to adjust slice thickness for one loaf independently of the other.

FIG. 4 schematically illustrates the drive connection from servo motor 171 to the head or spindle 148 in slicing station 66, through a belt 190; head 148 rotates counterclockwise as indicated by arrow D. Servo motor 172, on the other hand, rotates knife blade 149 clockwise (arrow E) through a drive connection afforded by two belts 191. Orbital movement of knife blade 149 depends upon the rotational speed of servo motor 171 and the speed of rotational movement of the blade is controlled by motor 172. Each can be varied independently of the other.

FIG. 4 also shows the manner in which stacker lift motor 173 is connected to receiving conveyor 130 by lift mechanism 138; the drive connection is afforded by connection of a yoke 192 to a timing belt 193 driven by servo motor 173. Thus, motor 173 acts to lift or lower receiver conveyor 130; these actions (arrows F) are carried out cyclically for each group of slices cut from the loaves fed into slicing station 66. Conveyor 130 also requires a drive motor, shown in FIG. 4 as the servo motor 176, driving conveyor 130 through a belt 194 in drive 101. During slicing of a pair of loaves motor 176 may rotate slowly in the direction of arrow C (clockwise as seen in FIG. 4) while motor 173 and mechanism 138 lower conveyor 130 to obtain precise vertical stacks for each group of slices from each loaf. If shingled groups are desired, motor 176 rotates slowly counterclockwise (opposite arrow C) while the loaves are sliced. When the slice groups are complete, motor 176 drives conveyor 130 and stacker pins 137 rapidly counter-clockwise to shift the group of slices, stacked or shingled as the case may be, onto deceleration conveyor 131. Thereafter, stacker motor 173 again elevates the receiver conveyor 130 rapidly to be in an elevated position, ready to receive two new groups of food loaf slices. The timing of these operations is described hereinafter.

As shown in FIG. 4, conveyors 131 and 132 share a common shaft 129, also seen in FIG. 3; a pulley 133 is mounted on shaft 129. Shaft 129 and pulley 133 are at a fixed height. The end of conveyor 131 opposite pulley 133 is adjustable upwardly and downwardly to the level necessary to receive groups of food loaf slices from conveyor 130; see arrows G in FIG. 4. The vertical movements of conveyor 131 are provided by mounting the inner end of conveyor 131 on a yoke 197 that is moved upwardly or downwardly by a motor 196. Motor 196 may comprise a pneumatic device, but a hydraulic device or an electrical motor could be used. The height of the end of deceleration conveyor 131 connected to yoke 197 does not change during slicing.

The outer (left-hand) end of scale conveyor 132 is dropped a short distance and subsequently elevated to the position illustrated in FIG. 4 each time a group of food loaf slices (usually two groups side-by-side) traverses the scale conveyor; see arrows H. This brief vertical movement of the outer end of conveyor 132 is effected by the scale lift mechanism 143. A pneumatic cylinder is preferred for lift 143; a hydraulic cylinder or an electrical linear motor could be used. When the outer end of conveyor 132 moves down, any group or groups of slices on conveyor 132 are deposited momentarily on scale grids 141 and 142 and weighed by load cells 198 and 199 respectively (grids 142 are not shown in FIG. 4). Mechanism 143 promptly moves scale conveyor 132 back up to again lift and carry the slice groups onward to classifier conveyors 134 and 135. Each group of food loaf slices that weighs in within a preset tolerance range is discharged downwardly with its classifier conveyor held down in the "in tolerance" position shown for classifier conveyor 134 in FIG. 4. The weight tolerance range may be different for slice groups on the near and far sides of scale conveyor 132. Each group of slices that does not come within the selected weight range is diverted upwardly by its classifier conveyor, held elevated in the "reject" position shown for conveyor 135 in FIG. 4. Vertical movements of the outer ends of classifier conveyors 134 and 135 are effected by linear lift mechanisms 144 and 145 for conveyors 134 and 135 respectively. Pneumatic cylinders are preferred for devices 144 and 145, but other mechanisms could be employed.

Each time scale conveyor 132 is moved downwardly (arrows H) by its lift mechanism 143, so that a group of food loaf slices on the scale conveyor is deposited on scale grid 141 on the near side of the slicing machine, load cell 198 weights that group of slices. It is this weighing operation that determines whether the classifier conveyor 134 is maintained in the lower "in tolerance" position shown in FIG. 4 or is moved up to the "reject" position shown for conveyor 135 in FIG. 4. Load cell 199 performs the same basic weighing operation for each group of food loaf slices on the far side of the machine. Thus, weight signals from load cells 198 and 199 are used to actuate cylinders 144 and 145 to elevate conveyors 134 and 135, respectively, to their "reject" alignments when food loaf slice groups are not in the preset weight ranges established for the loaves being sliced. Conversely, if a slice group weight is within the weight tolerance range, when weighed by one of the load cells 198 and 199, the signal from the applicable load cell is used to actuate the associated cylinder 144 or 145 to move the related classifier conveyor 134 or 135 down to its "in tolerance" position or to maintain that classifier conveyor down in the "in tolerance" position.

Conveyors 131, 132, 134 and 135 all are driven at the same preselected speed, in the direction of arrow A, FIG. 4. That speed is adjusted to fit requirements imposed by the speed of the cutting blade in station 66. A conveyor drive motor 260 is connected to a timing belt 261 that drives a spindle/pulley 262 serving both classifier conveyors 134 and 135. The drive spindle/pulley 262 is mounted on a shaft 263; the end of shaft 263 opposite belt 261 carries a drive pulley 264 in mesh with a timing belt 265 used to rotate shaft 129 and the spindle 133 that drives both of the belt conveyors 131 and 132.

Figure 5:
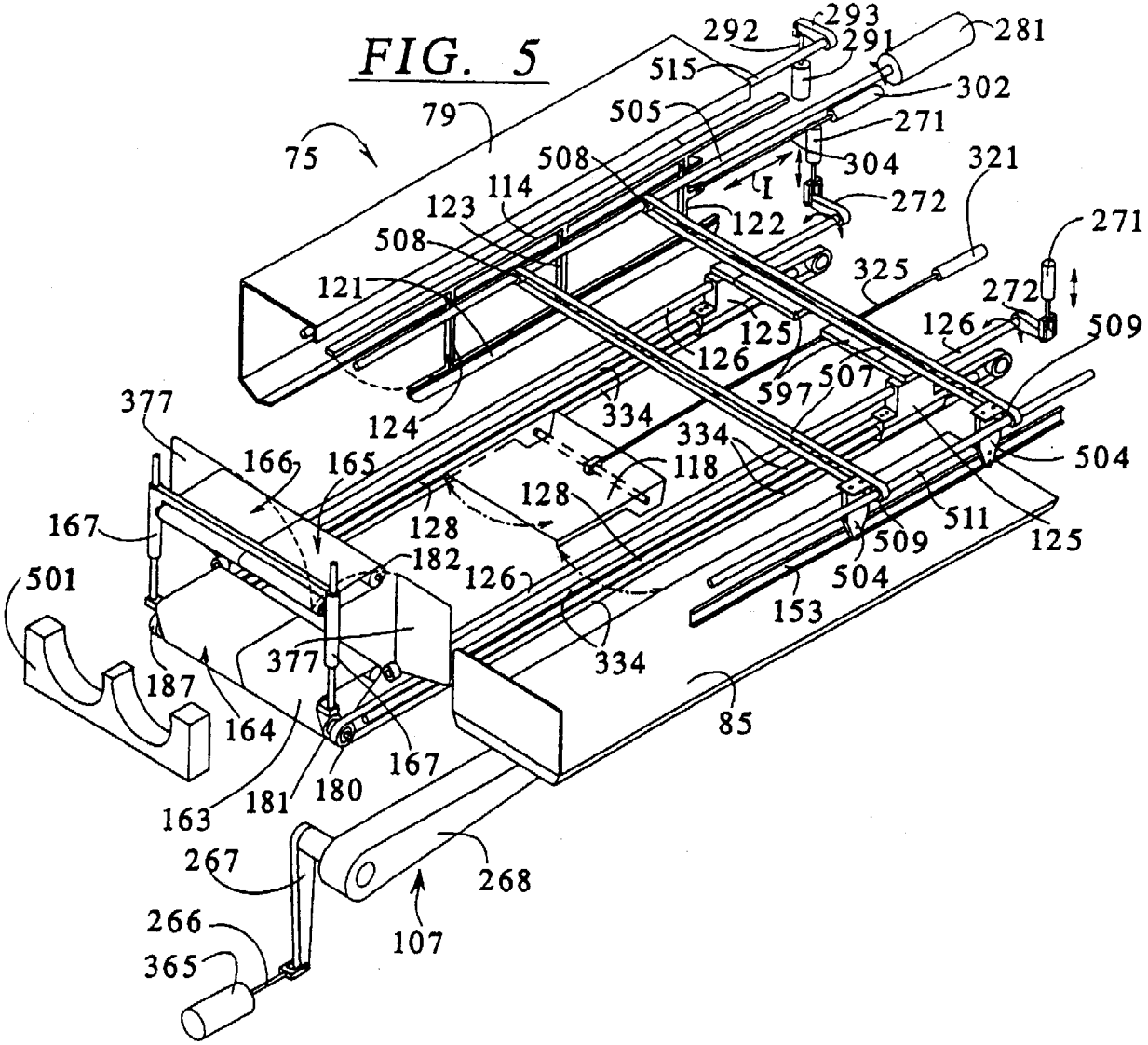

FIG. 5 affords a simplified schematic illustration of most of the loaf loading and loaf feed mechanisms in the slicing machine. Starting at the left-hand side of FIG. 5, there is a loaf lift cylinder 365 having an actuating rod 266 connected to a crank 267 that in turn drives a loaf lift lever 268. These members are all part of the loaf lift mechanism 107 that lifts storage tray 85 from its storage position (FIGS. 1–3) to a level even with the support on which food loaves rest during slicing. The loaf lift mechanism is actuated only during loaf loading; during a loaf feeding/slicing operation, cylinder 365 is not actuated and tray 85 remains in its storage position.

FIG. 5 shows the "short" conveyors 163–166, with the two upper "short" conveyors 165 and 166 mounted on the housings of cylinders 167. Cylinders 167 have fixed shafts; air applied under pressure to the cylinders tends to drive their housings, and hence conveyors 165 and 166, down toward the lower conveyors 163 and 164. Downward movement of the upper conveyors is blocked by a shear edge member 501 that is specific to the size of loaves being sliced, so that each pair of the conveyors engages opposite sides (top and bottom) of a food loaf being sliced. The drive spindles 181, 182, and 187 for conveyors 163, 165 and 164 also appear in FIG. 5; their drives are shown in FIG. 4.

Drive pulley 180, shown in FIG. 4, also appears in FIG. 5. It is in meshing engagement with a near side timing belt 334 that extends the full length of the loaf feed mechanism 75. Belt 334 is connected to gripper carriage 125 on the near side of the slicing machine and is used to drive the carriage toward the slicing station. There is a like gripper carriage 125 driven by another long timing belt 334 on the far-side of the machine. Two parallel shafts 126 and 128 guide movements of each of the carriages 125. Shafts 128 are stationary but each of the shafts 126 can be rotated by means of a loaf door cylinder 271 and a connecting crank 272.

Returning to the left-hand side of FIG. 5, it is seen that there are two loaf doors 377, one on each side of the feed mechanism 75, immediately to the right of conveyors 163–166. The near side loaf door 377 is mounted on shaft 126 so that it can be rotated to close off access of a food loaf into the space between conveyors 163 and 165. Similarly, the far side loaf door 377 is mounted on the other shaft 126 and can be rotated to close off access of a food loaf into the space between conveyors 164 and 166. Thus, doors 377 are used to block entry of food loaves into slicing station 66.

FIG. 5 shows barrier divider 121 suspended from auxiliary frame member 114 by three pivotal hangers 122–124. The hanger 122 at the right-hand end of barrier 121, as seen in FIG. 5, is connected by a shaft 304 to an air cylinder or other linear actuator 302. Linear actuator 302 is used to lift barrier 121, pivotally, to a point clear of any food loaves in the loaf feed mechanism.

On the near side of the versatile slicing machine 50, in feed mechanism 75, there is an elongated sweep 153; see the lower right-hand portion of FIG. 5. Sweep 153 is suspended from two hangers 504, each connected to a drive belt 507. There are structural members, not shown in FIG. 5, that afford further support for the hangers 504; see FIG. 3. Belts 507 are timing belts, each engaging a drive pulley 508 and an idler pulley 509. The idlers 509 are mounted on a shaft 511. The drive pulleys 508 are each affixed to a shaft 505 rotated by a loaf sweep motor 281.

FIG. 5 also shows the loaf feed door 118 that is a central part of the loaf support for the slicing machine. In FIG. 5 door 118 is in its normal elevated position, the position the door occupies when slicing is going forward. Door 118 is connected by a long rod 325 to a linear actuator 321 that opens the door to allow discharge of an unsliced butt end of a loaf; see FIGS. 2 and 3.

Some of the manual loaf loading components of mechanism 75 do not appear in FIG. 5; they are masked by the manual loaf door 79 which is mounted on a shaft 515. Shaft 515 is rotated by a manual door cylinder 291 connected to the shaft by its operating rod 292 and a crank 293.

B. The Computer Flow Chart, FIGS. 6A and 6B.

Slicing machine 50 (FIGS. 1–3) is fully computer controlled. Accordingly, basic operation can be described in conjunction with a flow chart indicative of the control functions carried out by the computer program. FIGS. 6A and 6B afford the requisite flow chart; FIG. 6B follows FIG. 6A. The basic preferred driver software is TOUCH BASE driver software, licensed by Touch Base, Ltd. through Computer Dynamics of Greer, S.C.; this driver software package allows operation of the touch screen functions used in slicing machine 50. If this driver software does not load on start up there is a serious problem with computer control.

At the outset, when slicing machine 50 is first placed in operation, power to the machine is turned on, as by actuation of an appropriate input power supply switch. This input power switch is not shown in the drawings; the power supply switch may be located in or on base 51 of machine 50. Calibration of the touch screen may be required on start up; if so the operator of the slicing machine initiates calibration by actuating switches 72 and 73 (FIGS. 1–3) simultaneously. If no calibration is needed, the first step in computer control of machine 50, in the initial part of the flow chart (FIG. 6A), is an initial start 201, also effected by the machine operator. This may be accomplished with the power supply switch referred to above, or an additional switch may be interposed in the circuit to energize computer 54 through the low voltage power supply 55 and the display/touch screen 69

(FIG. 1). In the next step 202 of the flow chart, a check is made to determine if the driver software is loaded; if not, a warning reset is supplied to step 201.

Once the driver software is loaded for step 202, and screen 69 has been energized, the program recorded in computer 54 (FIG. 1) performs a sequence of initial functions, indicated by step 203 in FIG. 6A. These initial functions may include initializing interrupt of vectors, graphics drives, determination of spindle tracking hours, establishment of product codes for defaults, and a check of a battery energized backup record memory (RAM). The computer program also sets the appropriate code to match the product to be sliced by the machine, selects several action boards previously set up in the computer, makes a determination of motion control interrupt functions, establishes raw data for scale arrays related to the food loaf products and the slicing operation, and selects previously recorded graphics pertaining to a wide variety of different products so that the graphics subsequently displayed on screen 69 match the product being processed. In addition, the computer program, in the course of the initial functions step 203 (FIG. 6A), sets the maximum knife speed ratio relative to the speed of slicing head 66 required for the desired slicing operation. For any of these initial functions, some input from the machine operator may be necessary; most inputs are effected by operator touch on screen 69 (FIGS. 1–3).

At this juncture, the touch/display screen 69 has been energized; the computer program for machine 50, in step 204, FIG. 6A, sets up a title page on the screen pertaining to the slicing and grouping operation or operations to be performed by machine 50. At the same time, or immediately thereafter, the computer program operates (step 205) to start up various power systems in machine 50. These functions may include initialization of an air pressure system or a hydraulic pressure system in machine 50, or both, depending on the requirements of operating components in the machine. Pneumatic actuation is usually preferred. A motor control power circuit, included in the high voltage power supply 56 (FIG. 1), is energized so that electrical motors (mostly A.C. servos) used to perform various functions in machine 50 have power available. In step 205 the computer program also determines appropriate sample periods for weighing operations and a seam correction for the scales actuated by weighing grids 141 and 142; the sample periods may be the same if machine 50 is to produce just one product from two or more separate loaves. In step 205 the computer program also determines the average slice thickness required for each product from machine 50. Again, the slice thicknesses (and the loaf and knife speeds that determine those thicknesses) may be the same, or they may be different for loaves sliced on the near and far sides of machine 50.

Once the computer program has completed the initializing functions of step 205, FIG. 6A, it starts an idle loop operation as indicated in step 206. This idle loop start step can go forward only if there are appropriate inputs from two flag determinations performed in steps 234 and 237 in FIG. 6B. When machine 50 has been idle, as is assumed, appropriate inputs are available from both of the two steps 234 and 237 in FIG. 6B.

At the beginning of the idle loop operation, step 206 in FIG. 6A, the program for slicing machine 50 tracks the running of calculation of a total time for the anticipated run of the slicing machine by reading start time and stop time and taking the difference; the computer also performs a plurality of other tracking functions, in step 207 (FIG. 6A). Thus, the computer records the total run time and also records the total time for power to be on, which may be somewhat longer. In step 207, the computer program may make a determination of the time period permissible before service of slicing machine 50 is required.

When these operations have been completed in step 207 the computer determines if an emergency stop check can be cleared in the next step 208. What this amounts to is a check to determine whether any of the emergency stop switches 87 and 89 have been actuated. If an emergency stop signal has been recorded, there is a "yes" output at step 209 in the program, resulting in initiation of a subsequent step 211. In step 211 the computer records a fault message, turns off all machine outputs, and stops all machine motors. If there is a "no" output at step 209, indicative of the fact that no emergency stop switch has been actuated, then a step 212 is carried out by the computer to clear any emergency stop message that may be held over from previous operations and to clear all flags from the control system.

In the next program step 213, FIG. 6A, the computer of slicing machine 50 makes a determination as to whether an emergency stop has been set. If this action has occurred, the next step 214 is the performance of a servo check by the computer and a determination of whether the drives for machine 50 are not ready for operation or if there has been a fault due to a thermal overload. In this step 214 the computer also may set a "stop now" flag. If such a flag is set, in the next step 215 the existence of that flag is identified and a further program step 216 is initiated to stop all motion in the slicing machine 50 and to carry out a normal shut down of that machine.

Returning to step 213, the computer may ascertain that no emergency stop has been set. In this circumstance, a step 217 is initiated to check whether all guards and doors have been closed on machine 50 and the motor drives for the slicing machine are ready for operation. In step 217 the computer also makes a determination of whether electrical faults have occurred as a result of vibration or other causes. If no fault is ascertained, an enabling output is produced in the next step 218 and fed back to the servo check of step 214. If a fault is found, the next program step 219 is initiated, setting a fault message, turning all outputs off, and stopping all motors in the slicing machine 50. The output from step 219 is supplied back to the servo check step 214. In FIG. 6A, it will be seen that steps 207–210 and 211–219 are all enclosed in a phantom outline 221, which is referred to again hereinafter in conjunction with a portion 248 of FIG. 6B.

The next step in the flow chart of FIG. 6A is a determination of whether a product removal flag has been set; see step 222. If such a flag has been set, a subsequent program step 223 is initiated. At this juncture, if the operator has held the load feed switch 73 (FIG. 1) actuated for a predetermined minimum period (typically five seconds) then the computer program prepares for product removal. Completion of step 223 or a determination in step 222 that no product removal flag has been set results in initiation of a further step 224, constituting a display of an emergency stop message on display screen 69 (FIG. 1).

Following step 224, in the next step 226 of FIG. 6A the recorded program of slicing machine 50 checks to determine whether a flag has been set to preclude jogging of the conveyor/classifier system 64. If there is an affirmative output from step 226, a subsequent step 227 starts jogging movement of the conveyor system. An output from step 227 or a negative output from step 226 initiates a subsequent step 228, which is a check to determine whether a flag has been set to stop jogging of the conveyor system. If no such flag has been set there is an output to the initial stage 232 of FIG. 6B. If there is an affirmative output from step 228, then an additional step 229 is carried out to stop jogging of the conveyor system 64 (FIG. 1).

FIG. 6B shows the steps for the remainder of the flow chart that began with FIG. 6A. At the beginning of the portion of the flow chart shown in FIG. 6B, there is a program step 232 in which the computer looks to see if there has been a start run and a fault set. If both conditions have occurred while attempting to start a run cycle, there is a YES output from step 232 to the next step 233 and a disabling cycle is initiated for slicing machine 50 by the program prerecorded in its computer. In the course of step 233, if there has been a run flag, so that running of the machine is not permissible, that flag may be cleared. Of course, the stated combination of conditions (lack of a start run or a run fault set) may not be found in step 232, in which case step 233 is by-passed. In either event, there is an enabling input to a further step 234 in the computer program, which again checks for the existence of a run flag. Actually, in step 234 the program is checking to see whether the cycle start switch 73 has been actuated by the operator. If not, there is an output to step 206 in FIG. 6A. If the operator has actuated the run/start control switch, there is an enabling output to the next step 235 in the flow chart.

In step 235 of the flow chart, FIG. 6B, the computer performs a variety of functions. To begin with, it records the time that machine 50 has been out of operation for faults and starts a number of machine subsystems in operation. Thus, in display 69 the computer program causes the display of a homing message. The knife 149 in slicing head 66 (FIG. 3) is brought to a home orientation. The grippers 151 of loaf feed system 75 (see FIG. 3) are also brought to their respective home positions. Other homing operations are performed for the conveyors of conveyor system 64. The computer checks to see if the enclosure doors for loaf feed system 75 are closed, as shown in FIG. 1. Center divider 121 (FIGS. 2 and 3) is raised to its elevated position, high enough to be clear of any loaf that may be moved onto the loaf supports (116–118) of the slicing machine. Grippers 151 are unactuated. The controls of machine 50 are set for automatic or manual loading. The loaf cover is raised, stacking conveyor 130 is elevated, and motion control for the machine is checked to see whether it has been cleared. The anticipated production start time is also recorded in step 235. When all of these operations have been completed, an output to step 236 in the flow chart is effected; machine 50 is now ready to start slicing. It is assumed that there is an appropriate input to program step 236 from the final step of the flow chart, as described below.

In the next step 237 of the program illustrated by the flow chart of FIG. 6B, the computer of machine 50 ascertains whether a flag has been set to permit running operation. This is a requirement imposed upon the machine operator. If it has not been fulfilled, there is a no output from stage 237 to step 206 in the portion of the flow chart illustrated in FIG. 6A, so that machine 50 reverts to its idle mode of operation. However, if the operator has set a run flag to indicate that machine 50 is ready for slicing and that such operation is desired, then there is an output from program step 237 to the next step 241.

It may be desirable to check for profile variations at the beginning and end of each food loaf sliced, in order to track taper of the loaf and made thickness corrections according to loaf profile trends. If profile corrections are to be made, step 241 affords a YES output to the next step 242 to make profile corrections. If there are to be no profile corrections, or if none are required, the next input is to program step 243. At this point, the touch screen 69 is checked to see if the operator has entered instructions by means of a touch; the selected screen image is displayed. In the succeeding step 244 the computer checks to see if gross weight is to be measured. If the answer is YES, a gross weight for the product is determined in step 245. When that weighing step is completed, or if no gross weight is to be determined, the flow chart goes on to a further step 246. In the next step 246 the computer ascertains whether a stop switch has been actuated or a fault has been found by the sensor switches of machine 50, such as sensor switches that determine whether all guards are in place. If, in step 246, it is determined that operation of the slicing machine 50 should not begin, then in the next step 247 all motion within the machine is interrupted and a normal shutdown is carried out. Step 247 is bypassed if there is a negative condition ascertained in step 246. After step 247, the program represented by the flow chart performs functions, in a composite step 248, that correspond in all respects to the functions described above for steps 207–209 and 211–219 in phantom outline 221 of FIG. 6A.

After the composite step 248, FIG. 6B, an input to the next step 252 in the flow chart may result in a determination that the gripper clamps 151 of machine 50 (FIG. 3) need to be retracted, or that they do not need to be retracted. If the gripper clamps must be retracted, then program step 253 comes into play. The clamps are retracted, and the average load time and number of loaves are tracked. On the other hand, step 253 in the program may be bypassed by a negative output from step 252. In either case, there is an enabling input to program step 254, where it is ascertained whether the grippers 151 are ready to grip food loaves. If yes, the gripping operation of step 255 is initiated. If no, the next subsequent step 256 is enabled. Step 256 may also be enabled by an output from step 255. As the food loaf slice groups constituting the output of slicing machine 50 move to position to be weighed on conveyor 132, an appropriate input has been made, prior to this time, by the computer program. In step 256 of the program flow chart, a positive output results in an enabling signal to the next step 257, to cause the machine to weigh each product slice group as it leaves the machine. If the sliced product group (or groups) is not in position for weighing, there is a negative output from step 256, or an output from step 257, supplied to the run loop start step 236 to maintain the slicing machine in operation. Either way, operation continues until a given desired slicing operation is finished.

C. The Method of the Invention

Figure 7:
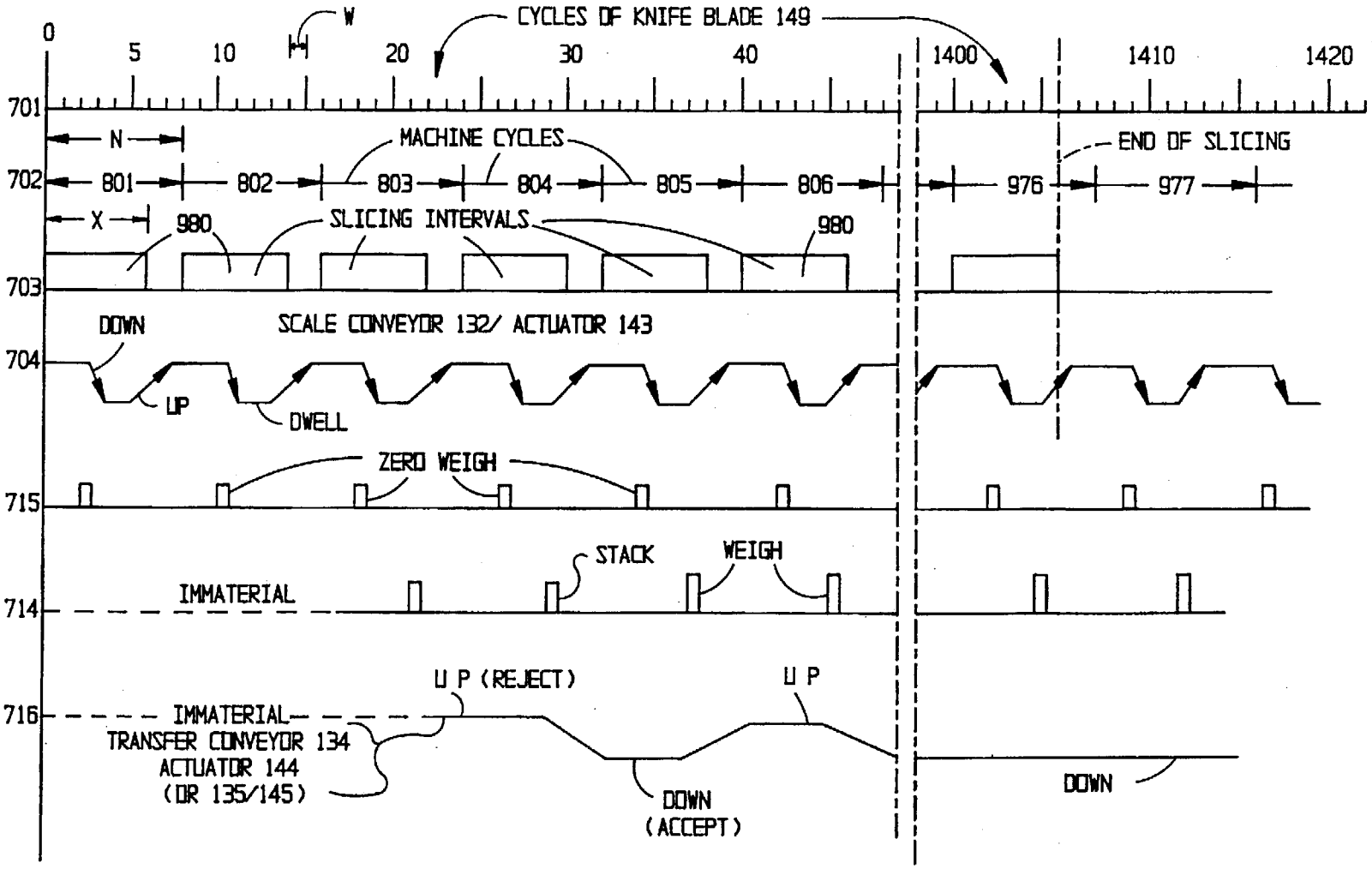
FIG. 7 is a timing chart employed to illustrate and explain the method of manufacturing groups of food loaf slices of the invention, using the slicing machine of FIGS. 1–6.
Figure 8:
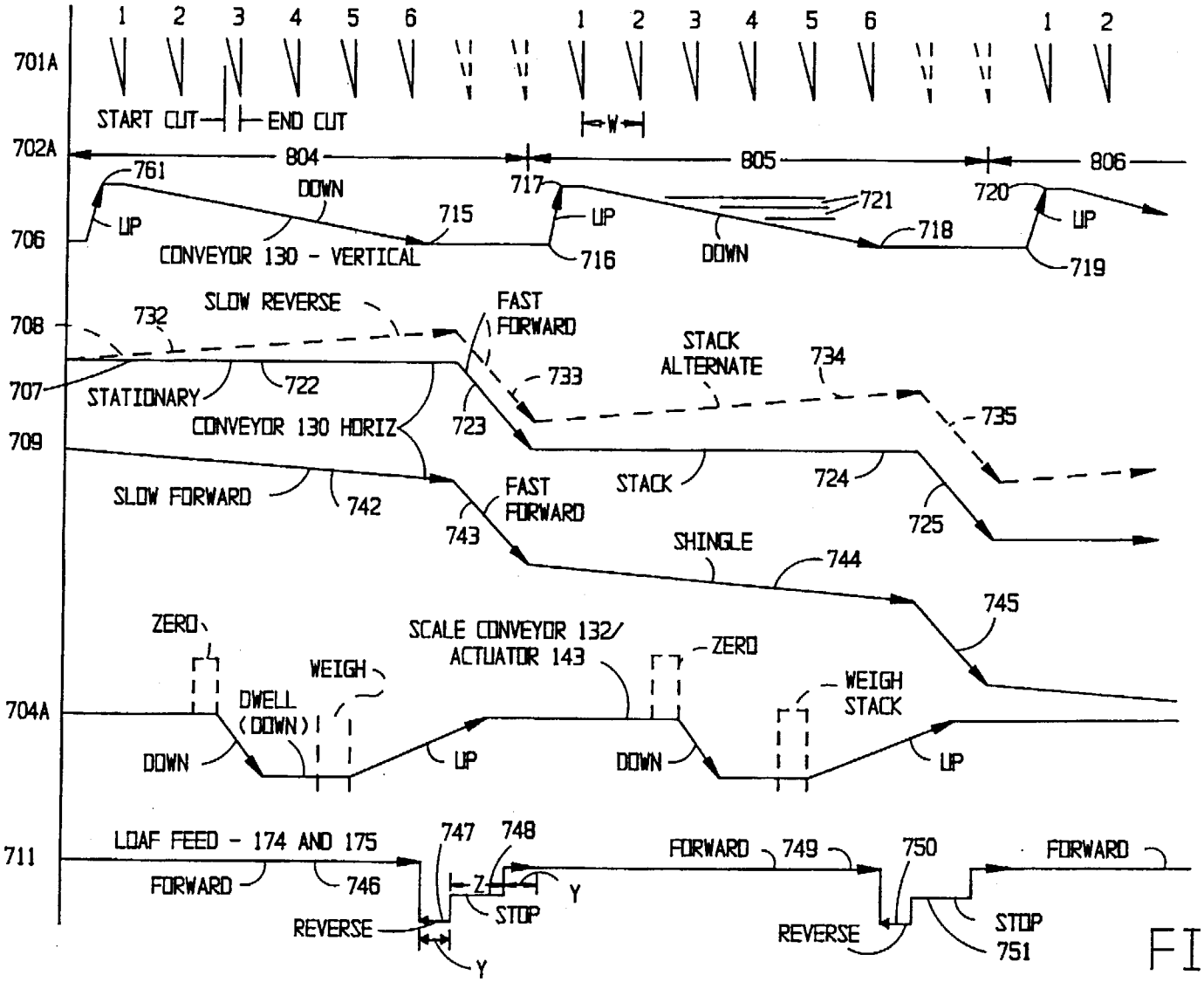
FIG. 8 is a timing chart, on an enlarged scale, of two cycles from FIG. 7.

FIGS. 7 and 8 are timing charts that illustrate critical functions in the operation of slicing machine 50, in carrying out the method of the invention. FIGS. 7 shows the sequence of slicing operations carried out by blade 149 in slicing head 66. FIG. 8 is specifically concerned with the timing of movements, both vertical and horizontal, of receiving conveyor 130, with further scales showing weighing operations and the timing of loaf feed operations. FIG. 7 is also directed to actuation of transfer conveyors 134 and 135 by their actuators 144 and 145 (see FIG. 4). FIG. 7 further illustrates the timing of operations for scale conveyor 132, along with the related timing of weighing operations, to facilitate correlation of the transfer conveyor operations with those of other portions of the machine.

At the top of FIG. 7 the scale 701 illustrates the cyclic operation of the knife blade in slicing station 66, in this instance the blade 149. Scale 701 starts at time zero, when slicing commences, and shows individual knife blade cycles from the beginning of a slicing operation through the forty-ninth knife cycle. Scale 701 also shows the timing of individual cyclical movements of blade 149 in its cycles 1,398 through 1,422. Each knife cycle in scale 701 has a predetermined duration that is determined by the computer control for slicing machine 50. That is, the duration of each of the individual knife cycles in scale 701 may vary considerably, depending upon the speed at which knife blade 149 moves orbitally and rotationally. Each knife cycle indicated in scale 701 of FIG. 7 represents a complete orbital movement of knife blade 149 and may include several rotations of the knife blade. For FIG. 7, and also for FIG. 8, it is assumed that there are to be six food loaf slices in each group sliced by machine 50 (see food loaf slice groups 92 and 93 in FIGS. 1 and 2). At the right hand end of scale 701, knife cycle 1,406 is assumed to represent the end of slicing operations. At this point 176 groups of slices have been cut from the food loaves.

The next scale 702 in FIG. 7 pertains to the individual overall operating cycles of machine 50 as employed in carrying out the method of this invention. These machine cycles are sometimes referred to as "manufacturing cycles". Each includes N knife blade cycles. In FIGS. 7 and 8 N=8. Thus, under the assumptions noted above, after six slices have been cut from a food loaf there are two knife cycles (scale 701) in which no slicing occurs. These non-slicing cycles enable the machine to discharge a slice group from the receiving conveyor 130 to the next part of the classifier/conveyor system 64 (deceleration conveyor 131 in FIG. 4). In this same time interval the slicing machine is again conditioned for cutting a new slice group. Consequently, and as indicated by scale 702 in FIG. 7, for the assumed conditions each of the machine (manufacturing) cycles 801–806, 976 and 977 corresponds to eight cycles of knife blade 149 in slicing station 66, scale 701.

The intervals 980 when slicing actually occurs are as shown in the third scale 703 of FIG. 7. That is, in each machine cycle, scale 702, in the first six cycles of the knife blade 149 a new slice is cut from the meat loaf; actually, two slices are cut in each knife blade cycle if, as usual, two loaves are sliced simultaneously. Thus, X=6. In the next two knife cycles within each machine cycle, however, there is no slicing operation. Instead, the slice groups already cut are transferred from receiving conveyor 130 to deceleration conveyor 131 (FIG. 4) and receiving conveyor 130 is restored to its initial operating condition to receive the next group of slices.

The next scale 704 in FIG. 7 relates to the timing of operation of scale conveyor 132 and its vertical actuator 143. At some point in each manufacturing cycle, in this instance a point assumed to correspond to the end of the third knife cycle, actuator 143 pulls the outer (left-hand) end of scale conveyor 132 down (FIG. 4) so that any group of slices on conveyor 132 is deposited on one of the scale grids 141 and 142, as previously described. In the first machine cycle 801 there is no group of slices on scale conveyor 132 so that its actuator 143 lifts conveyor 132 to its "reject" level; no weighing operation occurs. This is also true during the second manufacturing cycle 802; see scales 702 and 714. By the time the third machine cycle 803 has begun and slicing of the food loaves is resumed for a third time, one (or two) group of food loaf slices is present on scale conveyor 132. Thus, in the third slicing interval, during machine cycle 803 (scales 702 and 703 of FIG. 7) weighing does take place during the time interval that actuator 143 has pulled conveyor 132 down so that the groups of food loaf slices are supported upon the scale grids; see scale 714. Thereafter, in each cycle of machine operation, any groups of slices present on scale conveyor 132 are weighed.

For FIG. 7, it has been assumed that conveyor/classifier system 64 advances the food loaf groups in the direction of arrow A (FIG. 4) at the same rate that they are cut and that weighing of the slice groups occurs during a single knife cycle, the sixth cycle in each slicing interval. However, this is not necessarily the case; the slice group weighing operation at conveyor 132, scale 714, may require a longer interval than one knife cycle or it may be completed in a shorter time, depending upon the speed of operation of actuator 143. The two time requirements are independent of each other. Of course, weighing of slice groups should be continued after slicing has been finished so that the last few groups of food loaf slices will be weighed. That is why, at the right hand side of FIG. 7, the weighing intervals (scale 714) continue after slicing ends with cycle 1,406 of blade 149.

In carrying out the preferred method of the invention each group of slices is weighed to determine whether the group comes within pre-set tolerance limits. It is also important that the integrity of the weighing operation be maintained. To this end, a zero or "tare" weight is determined for each load cell 198 and 199 (FIG. 4) in each machine cycle. As shown by scale 715 in FIG. 7, this is carried out, in part, by taking a zero weight measurement in each machine cycle. The zero weight determination made in each cycle is subtracted from the gross stack weight measured shortly thereafter, in the same cycle; see scale 714 in FIG. 7. Thus, if the total weight of one weighing grid changes, as when a small portion of food loaf material or some other item of debris clings to the grid, while slicing is going forward, that excess weight is included in the "zero" weighing step and does not result in a false weight determination for succeeding stacks. By the same token, if the excess material is subsequently dislodged from the grid, later zero weight measurements reflect the change; the weighing of subsequent slice groups is still accurate.

In FIG. 8 the uppermost scale 701A corresponds to eighteen cycles of knife 149, from scale 701 in FIG. 7, occurring in machine cycles 804–806, scale 702A. As slicing begins, near the beginning of machine cycle 804 at the left hand side of FIG. 8, receiving conveyor 130 is restored to its uppermost position at point 761 and then begins to move vertically downwardly at a relatively slow rate, as indicated by curve 706. This downward movement is continued during the first six knife blade cycles in machine cycle 804, while slices are cut from the loaves being fed into the slicing station in machine 50. At point 715 in FIG. 8, shortly after the end of the sixth knife cycle in machine cycle 804, the downward movement of receiving conveyor 130 is interrupted and the receiving conveyor is maintained at a constant level by its lift mechanism 138 (FIG. 4). At this juncture, receiving conveyor 130 is at approximately the same level as the next adjacent deceleration conveyor 131 (see FIG. 4).

Thereafter, starting at point 716 in FIG. 8, before the beginning of the first knife cycle in the next manufacturing cycle 805, when a new slicing operation begins, receiving conveyor 130 is moved rapidly upwardly to an elevated position (point 717) where it is ready to receive a new food loaf slice, the first slice cut in cycle 805. During the first six (cutting) cycles in machine cycle 805, after a brief dwell, receiving conveyor 130 again moves downwardly. Following point 718 on curve 706, there is again a dwell, extending to point 719, during which there is no vertical movement of receiving conveyor 130. Thereafter, rapid upward movement of the receiving conveyor is again carried out, to point 720, to restore the receiving conveyor to the elevation at which the first slice is received, again following a brief dwell. The upward and downward movements of receiving conveyor 130 are effected by motor 173 and mechanism 138 (FIG. 4). Each incremental downward movement 721 of receiving conveyor 130 should be approximately the same as the thickness of a slice cut from a food loaf during a given cycle of blade 149 so that the vertical position at which receiving conveyor 130 "catches" a downwardly moving slice is always the same.

As pointed out previously, slicing machine 50 can produce stacked food loaf slices. Curve 707 illustrates one mode of horizontal operation for receiving conveyor 130 when the food loaf slices are to be stacked. In the initial portion 722 of curve 707, extending through the sixth cycle of knife blade 149 in machine cycle 804, there is no horizontal movement for receiving conveyor 130. That is, during interval 722 motor 176 does not drive the belts of conveyor 130 (FIG. 4); those belts remain essentially stationary. This is also true of the receiving pins 137 that are on pin wheels interleaved with the belts of conveyor 130 and driven at the same peripheral speed as the belt speed.

During the next interval 723 of curve 707, FIG. 8, while vertical movement of receiving conveyor 130 is interrupted (between points 715 and 716 in curve 706) receiving conveyor 130 is driven forward rapidly by motor 176 and drive mechanism 101 (FIG. 4) to discharge an accumulated stack of food loaf slices from receiving conveyor 130 to deceleration conveyor 131. This discharge operation must be completed before the receiving conveyor is again elevated to receive the next stack at point 717 in curve 706. During the next interval 724 in curve 707 receiving conveyor 130 again remains essentially stationary as regards horizontal motion; drive motor 176 is quiescent. However, the next time that vertical movement of receiving conveyor 130 is interrupted (after point 718 on curve 706) the receiving conveyor again enters a period 725 (curve 707) when it is driven rapidly forward, in the direction of arrow A (FIG. 4), to again unload an accumulated stack of food loaf slices onto the next conveyor in system 64, deceleration conveyor 131.

In FIG. 8, curve 708 shows an alternate to curve 707, which may be employed when the groups of food loaf slices are to be stacked as cut. The segments 732, 733, 734, and 735 of curve 708 correspond in timing to the sections 722–725, respectively, of curve 707. In the alternative curve 708, however, during each of the intervals 732 and 734 there is a slow movement of the conveyor in a reverse direction. That is, during these intervals 732 and 734 the belts of conveyor 130 and pins 137 are driven in a direction opposite to arrow A (FIG. 4). In some instances, this alternate stacking sequence improves the configuration of the stacks, which may tend to become deformed due to lateral forces applied to the slices by the rotating knife blade as the slices are cut.

Curve 709, FIG. 8, illustrates the manner in which the receiving conveyor 130 is driven, for horizontal movement, when the groups of cut food loaf slices are to be shingled rather than stacked. During the first six knife cycles in machine cycle 804, the initial portion 742 of curve 709, receiving conveyor 130 is driven slowly forward by motor 176 and drive linkage 101 (FIG. 4). As a consequence, the eight slices cut from the food loaf during interval 742 are shingled rather than stacked on receiving conveyor 130. The first slice falling onto the receiving conveyor impinges upon receiving pins 137, which operate at the same speed as the belts of the conveyor, assisting in the shingling operation. During the next interval 743, however, as in curves 707 and 708, it is necessary to discharge the shingled group of food loaf slices from receiving conveyor 130 onto deceleration conveyor 131. Thus, during the interval 743 of curve 709, pertaining to shingling of the slice groups, receiving conveyor 130 is driven rapidly forward to discharge the shingled group of slices onto deceleration conveyor 131. Thereafter, during interval 744, slow horizontal movement of the receiving conveyor is resumed, again followed by a rapid discharge motion in interval 745.

For consistency of slicing, and to maintain the integrity of the slice groups produced by machine 50, the feeding of food loaves into slicing station 66 (FIG. 4) is interrupted at the end of the slicing of each group. If this is not done, extraneous slices may be cut, producing highly indeterminate operation of the slicing machine. Furthermore, it is not sufficient simply to stop the food loaf feeding movement into slicing station 66 (FIG. 4). Rather, it is desirable to clear the food loaves from the slicing station in order to avoid cutting of thin slices or other malfunctions in the slicing operation.

In FIG. 8, the scale 711 shows the timing of operations for the loaf feed provided by motors 174 and motor 175 during operation of the slicing machine. During a first interval 746 approximately coincident with the first six cycles of knife blades 149 in manufacturing cycle 804, while slices are being cut from the food loaf or food loaves, the loaf feed operates in a forward direction to advance the food loaves into slicing station 66 as previously described. In a substantially shorter interval 747 immediately following this normal loaf feed during interval 746, however, the loaf feed is reversed. This is followed by another brief interval 748 during which loaf feed is stopped. Thus, during the seventh and eighth cycles of knife blade 149 in manufacturing cycle 804 the food loaves are first displaced away from slicing station 66 and its continuously operating knife blade 149 during interval 747, and then loaf feed is interrupted during interval 748. Thereafter, in an interval 749, the food loaves are again moved forwardly into the slicing station. This motion continues until the slicing of the next group of food loaves is completed at the end of the sixth cycle of knife blade 149 in the next manufacturing cycle 805. Food loaf motion is reversed during the next time interval 750 and stopped for a further brief interval 751, after which forward motion of the food loaves is again resumed.

The reverse movement of the food loaves during intervals 747 and 751 does not occupy the entire time, two knife cycles, during which the cutting operation in slicing station 66 is interrupted to enable the machine to advance one group of slices from the receiving conveyor to the deceleration conveyor and to start cutting the next group of slices. If reverse movement were continued throughout the time that no slices were cut, in this instance two knife blade cycles, the food loaves would not be ready and available for cutting of the next group of slices. Thus, with two non-slicing knife blade cycles interposed between each slicing interval 980 (see scale 703 in FIG. 7) the reverse movement of the loaf feed (FIG. 8) is maintained for only a part of one of the two knife blade cycles and then stopped. Forward movement is resumed in each machine cycle before slicing again begins to bring the meat loaf (or loaves) back to the correct position for resumption of slicing. FIG. 8 includes a curve 704A, like scale 704 in FIG. 7, to aid in correlation of the two timing charts.

Operation of the transfer conveyors 134 and 135 must also be coordinated with other machine operations. Thus, as shown in FIG. 7 by the scale 716, which begins after the twentieth cycle for knife blade 149, each transfer conveyor such as conveyor 134 (FIG. 4) is usually initially maintained in the elevated reject position by its vertical actuator 144. Actually, when slicing begins the positions of the transfer conveyors are immaterial because there are no food loaf slice groups discharged from the slicing machine as yet. The weighing operation is probably going to show that the first stacks cut (in machine cycle 801) are light in weight and hence out of tolerance. Thus, in machine cycle 804 the groups of food loaf slices are likely to be out of tolerance so that the transfer conveyor is maintained in the reject position; see scale 716.

In the next operation of scale conveyor 132, however, in manufacturing cycle 805, it is far more likely that any slice group on the scale conveyor will weigh in within tolerance. In that circumstance, device 144 is actuated, in response to the weight signal, to shift transfer conveyor 134 down to its in tolerance (accept) position. This makes it possible for the sliced group to be discharged to an "accept" takeway conveyor (not shown) rather than to a "reject" conveyor. In normal operation of slicing machine 50, thereafter, transfer conveyor 134 is held down because the sliced group are usually within the preset weight tolerance. The operation of transfer conveyor 134 illustrated by curve 716 in FIG. 7 is also typical of the other transfer conveyor 135 and its vertical actuator 145; see FIG. 4.

From FIGS. 7 and 8, and the previous description of slicing machine 50, it will be apparent that each machine cycle includes a given number (N) of knife blade cycles but that cutting actually occurs in only a smaller number (X) of knife blade cycles. See FIG. 7. The numbers N and X change, depending upon the food loaf or loaves being sliced, the quantity of slices in each group, and like factors. However, X is always smaller than N. In the example on which FIGS. 7 and 8 are based, N=8 and X=6. But the relationships do not change; during each of X knife blade cycles slices are cut from the loaves fed into the slicing station of the machine, but during the balance (N–X) of each manufacturing cycle the slice groups are discharged from receiving conveyor 130 to deceleration conveyor 131 and the loaf feed drive is reversed twice; see curve 711, FIG. 8.

In each maufacturing cycle scale conveyor 132 is moved down and then back up by its actuator 143 (FIG. 4) to weigh any slice groups on the scale conveyor; see curve 704 in FIG. 7 and curve 704A in FIG. 8. The weighing at scale conveyor 132 controls the positions of transfer conveyors 134 and 135; see curve 716 in FIG. 7. A further weighing operation can be effected by incorporating one or two scales in the receiving conveyor 130; see grid 136 in FIG. 3. In this arrangement each slice group is weighed twice, once at conveyor 130 and again at conveyor 132. A dual weighing system of this kind is sometimes desirable, as in bacon slicing operations. When an initial weighing operation is carried out at receiving conveyor 130, the groups of food loaf slices are accumulated on the weighing grid rather than on the conveyor. In this situation curve 706 of FIG. 8 applies to the receiving weighing grid, not to conveyor 130.

In a typical slicing machine utilizing the method of the present invention, each knife blade cutting cycle (scale 701A, FIG. 8) starts at about 95° in the orbital cycle of the knife blade, the rotational cycle of head 148 (FIGS. 3 and 4). The end of the cutting cycle coincides approximately with an orbital position of about 195°. As previously noted, the knife cutting cycle is determined by oribtal speed of the knife blade in the described slicing machine; the knife cycle is not dependent on the rotational speed of the knife blade. In a slicing machine using a contoured knife blade, with only rotational movement (no orbit), this does not apply; the rotational speed of the knife blade then determines the duration of the knife cycles.

To afford a more comprehensive example of the present invention, the durations of several steps depicted in FIGS. 7 and 8 and the speeds of several conveyors are presented in Table I. It should be understood that these are given as typical only for a given food loaf slicing situation; all of these numbers may and will change for different numbers of slices in slice groups, different food loaf feed rates and slice thicknesses, and numerous other factors.

TABLE I (EXEMPLARY ONLY)
(FIG. 8)

| Operation | Time |
|---|---|
| W, knife blade cycle (701A) | 80 milliseconds |
| Weighing intervals (704A) | 48 milliseconds |
| Scale conveyor 132 down (704A) | 75 milliseconds |
| Scale conveyor 132 up (704A) | 185 milliseconds |
| Scale conveyor 132 dwell (down) (704A) | 135 milliseconds |
| Transfer conveyor 134 or 135, up or down (716) | 335 milliseconds |
| Receiving conveyor 130, fast forward | 120 milliseconds |
| Reverse loaf feed and restore loaf feed (711) | 40 milliseconds |
| Stop loaf feed (711) | 80 milliseconds |

| Conveyors | Speed |
|---|---|
| 130 fast (707–709) | 325 feet/min. |
| 130 slow (708, 709) | less than 325 feet/min. |
| 131, 132, 134, 135 | 105 feet/min. |

We claim:

1. A method of manufacturing two series of groups of food loaf slices comprising the following steps:

A1. driving a first food loaf at a first constant loaf feed speed in a first loaf feed direction toward engagement with a continuously cyclically driven knife blade for X knife blade cycles so that the knife blade cuts a slice from the first food loaf in each knife blade cycle;

A2. driving a second food loaf at a second constant loaf feed speed in a second loaf feed direction, parallel to the first loaf feed direction, toward engagement with the knife blade for X knife blade cycles so that the knife blade cuts a slice from the second food loaf in each knife blade cycle;

B. collecting successive food loaf slices cut in steps A1 and A2 on a receiver to form two groups of X food loaf slices, one from each loaf, on the receiver;

C. driving both food loaves away from the knife blade at a given speed for a given time interval Y;

D. again driving both the food loaves toward the knife blade at their respective given speeds for a second time interval Y to counteract step C;

E. discharging the two groups of food loaf slices from the receiver onto a plural-belt scale conveyor driven in a forward direction away from the knife blade;

F. after step E, weighing the two groups of food loaf slices by means of two weighing grids each positioned below but interleaved with the belts of the scale conveyor to generate two weight signals, one representative of the weight of the food loaf slice group cut from the first food loaf and the other representative of the weight of the food loaf slice group cut from the second food loaf;

F1. effectively lowering the scale conveyor relative to the two weighing grids once during each step F to deposit any group of food loaf slices present on the scale conveyor on a weighing grid;

F2. after sub-step F1, restoring the scale conveyor to its original level above the weighing grids to lift the food loaf slice group from the weighing grid;

F3. weighing each empty weighing grid at a time when the scale conveyor is at its original level above the weighing grids to generate two tare weight signals;

F4. subtracting each tare weight signal of sub-step F3 from the corresponding weight signals of step F to generate two weight control signals relating to the net weight of a stack of food loaf slices;

G. depositing each group of food loaf slices from the scale conveyor onto a transfer conveyor;

H. deflecting each transfer conveyor between a reject position and an accept position in response to the transfer conveyor weight control signal of step F4;

I. recording two target weights, one for a group of food loaf slices cut from the first food loaf and the other for a group of food loaf slices cut from the second food loaf;

J. adjusting the first and second loaf feed speeds of steps A1 and A2 in accordance with differences between the target weights of step I and the related weight control signals of step F4;

and repeating steps A through H and J in manufacturing two series of food loaf slice groups, each group including X slices.

2. A method of manufacturing two series of groups of food loaf slices comprising the following steps:

A1. driving a first food loaf at a first constant loaf feed speed in a first loaf feed direction toward engagement with a continuously cyclically driven knife blade for X knife blade cycles so that the knife blade cuts a slice from the first food loaf in each knife blade cycle;

A2. driving a second food loaf at a second constant loaf feed speed in a second loaf feed direction, parallel to the first loaf feed direction, toward engagement with the knife blade for X knife blade cycles so that the knife blade cuts a slice from the second food loaf in each knife blade cycle;

B. collecting successive food loaf slices cut in steps A1 and A2 on a receiver to form two groups of X food loaf slices, one from each loaf, on the receiver;

C. driving both food loaves away from the knife blade at a given speed for a given time interval Y;

D. again driving both the food loaves toward the knife blade at their respective given speeds for a second time interval Y to counteract step C;

E. discharging the two groups of food loaf slices from the receiver onto a plural-belt scale conveyor driven in a forward direction away from the knife blade;

F. after step E, weighing the two groups of food loaf slices by means of two weighing grids each positioned below but interleaved with the belts of the scale conveyor to generate two weight signals, one representative of the weight of the food loaf slice group cut from the first food loaf and the other representative of the weight of the food loaf slice group cut from the second food loaf;

F1. effectively lowering the scale conveyor relative to the two weighing grids once during each step F to deposit any group of food loaf slices present on the scale conveyor on a weighing grid;

F2. after sub-step F1, restoring the scale conveyor to its original level above the weighing grids to lift the food loaf slice group from the weighing grid;

F3. weighing each empty weighing grid at a time when the scale conveyor is at its original level above the weighing grids to generate two tare weight signals;

F4. subtracting each tare weight signal of sub-step F3 from the corresponding weight signals of step F to generate two weight control signals relating to the net weight of a stack of food loaf slices;

I. recording two target weights, one for a group of food loaf slices cut from the first food loaf and the other for a group of food loaf slices cut from the second food loaf; and J. adjusting the first and second loaf feed speeds of steps A1 and A2 in accordance with differences between the target weights of step I and the related weight control signals of step F4;

and repeating steps A through F and J in manufacturing two series of food loaf slice groups, each group including X slices.

3. A method of manufacturing two series of groups of food loaf slices, according to claim 2, in which the receiver of step B includes a receiver conveyor, and comprising the following sub-step:

E1. during step E, discharging any food loaf slice group from the receiving conveyor by driving the receiving conveyor rapidly, in a predetermined forward direction, away from the knife blade.

4. A method of manufacturing two series of groups of food loaf slices, according to claim 2, in which step F3 occurs before step F1 in each manufacturing cycle.

5. A method of manufacturing two series of groups of food loaf slices, according to claim 2, and comprising the following additional sub-steps:

C1. interrupting driving of each food loaf for a given time interval at the end of the time interval Y of step C; and C2. maintaining the interruption of sub-step C1 for a predetermined time interval.

* * * * *